US005370958A

United States Patent [19]

Shin et al.

[11] Patent Number: 5,370,958

[45] Date of Patent: Dec. 6, 1994

[54] ELECTROPHOTOGRAPHIC TONER AND PRODUCTION PROCESS THEREOF

[75] Inventors: Masaaki Shin; Kenji Uchiyama; Yasuo Okada, all of Kanagawa, Japan

[73] Assignee: Mitsui Toatsu Chemicals, Incorporated, Tokyo, Japan

[21] Appl. No.: 10,871

[22] Filed: Jan. 29, 1993

[30] Foreign Application Priority Data

Jan. 31, 1992 [JP] Japan ..... 4-015877
Apr. 27, 1992 [JP] Japan ..... 4-107510

[51] Int. Cl.[5] ..... G03G 9/087
[52] U.S. Cl. ..... 430/110; 430/137
[58] Field of Search ..... 430/108, 110, 106, 137

[56] References Cited

U.S. PATENT DOCUMENTS 3,938,992 2/1976 Jadwin et al. ..... 252/62.1
4,504,563 3/1985 Tanaka et al. ..... 430/109
5,147,750 9/1992 Nakanishi ..... 430/110
5,241,019 8/1993 Otsuki et al. ..... 430/904

FOREIGN PATENT DOCUMENTS 0347800 12/1989 European Pat. Off. .
0412712 2/1991 European Pat. Off. .
4016672 11/1990 Germany .

*Primary Examiner*—John Goodrow
*Attorney, Agent, or Firm*—Oblon, Spivak, McClelland, Maier & Neustadt

[57] ABSTRACT

An object of the present invention is to provide an electrophotographic toner for high-speed copying machines having a high hot-roll speed and capable of fixing a toner at lower temperatures. The toner according to the present invention comprises a vinyl resin which has a wide molecular-weight distribution (Mn:1,000–20,000, Mw: 50,000–2,000,000), a glass transition temperature (Tg) of 40°–75° C. and a low acid value (AV:1–10); and a glycidyl compound in an amount sufficient to provide 0.05–1.0 equivalent of glycidyl groups per equivalent of COOH groups in the vinyl resin. It assures well-balanced fixing property, offset resistance and blocking resistance. In particular, it exhibits a remarkable effect in improving offset resistance and also in grindability during the production of the toner.

9 Claims, No Drawings

ELECTROPHOTOGRAPHIC TONER AND PRODUCTION PROCESS THEREOF

BACKGROUND OF THE INVENTION

1) Field of the Invention

This invention relates to an electrophotographic toner suitable for use in developing electrostatic latent images in electrophotography, electrostatic recording, electrostatic printing and the like. More specifically, this invention relates to an electro-photographic toner capable of meeting requirements even for high-speed copying machines, while assuring well-balanced fixing and offset resistance and excellent grindability.

2) Description of the Related Art

Electrophotography as practiced in a PPC (plain paper copier) copying machine or printer generally comprises forming an electrostatic latent image on a photoconductor, developing the latent image with a toner, transferring the toner image onto a base sheet such as a paper sheet and then heating and fixing the toner image by a hot roll. Since fixing is conducted under heat and pressure, this process features high speed and excellent thermal efficiency, hence, superb fixing efficiency. This hot roll method is, in contrast to its excellent thermal efficiency, accompanied by the so-called offset phenomenon, that is, the problem that because the toner is brought into contact with a surface of the hot roll, the toner is stuck and transferred onto the surface of the hot roll and is then transferred back onto the next base sheet to smear the same.

On the other hand, there has been a steady demand toward high-speed copying machines. This has naturally resulted in a higher fixing roll speed, leading to a demand for a toner which requires only short-time heating for its fixing. From the viewpoint of energy saving or higher safety, there is also a strong desire for the development of a toner which can be fixed at a temperature as low as possible. To fix a toner at a low temperature, the toner is required to fuse at a temperature as low as possible and also to show excellent flowability in a fused state. To obtain a toner which fuses at such a low temperature and shows excellent flowability, it is necessary to lower the molecular weight of a resin to be employed. A reduction in molecular weight, however, leads to a resin having insufficient cohesive force, whereby the offset phenomenon tends to occur more readily. Such a low molecular weight is therefore not preferred. To cope with this problem, a low-molecular resin is generally blended with a high-molecular resin although the flowability is somewhat sacrificed, so that the low cohesive force of the low-molecular resin is supplemented by the cohesive force of the high-molecular resin. Examples of such techniques are proposed, for example, in Japanese Patent Publication Nos. 6895/1980 and 32180/1988, U.S. Pat. No. 4,921,771, etc. Such techniques are however still insufficient for the tendency toward higher copying speeds and, in many instances, countermeasures are taken based on improvements in copying machines. For example, silicone oil is coated on a surface of a hot roll by fabric or paper to prevent offsetting. In this case, the construction of the copying machine becomes complex so that its repair and maintenance are complicated, leading to higher repair and maintenance cost. This approach is hence not preferred. There is accordingly a demand for the development of a fixing toner, which is a toner for high-speed machines and is suitable for use in the oilless fixing method that does not require use of oil such as silicone oil.

In the development of toners for the oilless fixing method, numerous toners making use of a crosslinked polymer have been proposed as preventive measures for offsetting. For example, Japanese Patent Publication No. 36582/1985 discloses use of a crosslinked polymer produced by emulsion polymerization. In this case, the crosslinked polymer employed contains 50–99% of a gel component. As the content of such a gel component increases, offset resistance is improved but grindability is reduced. As the content of a crosslinked polymer component decreases, on the other hand, grindability is improved but offset resistance is not improved. It has hence been extremely difficult to satisfy both offset resistance and grindability. In addition, this method requires combined use of a dispersant or dispersion aid upon production of a crosslinked polymer. Such a dispersant or dispersion aid, however, is highly hygroscopic so that it adversely affects electrical properties, especially charge stability. It is therefore necessary to eliminate the dispersant or dispersion aid as much as possible after the production of the crosslinked polymer. A great deal of labor is however needed to completely eliminate the dispersant or dispersion aid by washing the resultant crosslinked polymer. This washing produces a lot of waste water, thereby posing a further difficulty in its treatment. U.S. Pat. No. 4,966,829 discloses to the effect that a good toner can be obtained by including a vinyl polymer which contains 0.1–60 wt. % of a gel component and, when analyzed by GPC in a form dissolved in THF, presents a main peak corresponding to molecular weights of 1,000–25,000 and at least one subpeak or shoulder corresponding to molecular weights of 3,000–150,000. However, the process adopted to produce the vinyl polymer is suspension polymerization which, like emulsion polymerization, also requires combined use of a dispersion or dispersing aid upon practice. The toner disclosed in this U.S. patent is therefore accompanied by exactly the same problem as the emulsion polymerization described above. With a view toward overcoming this problem, the present inventors have already provided, as a toner resin having good fixing property, a resin produced by solution polymerization (see U.S. Pat. No. 4,963,456).

A resin produced by solution polymerization requires elimination of a solvent subsequent to the completion of the polymerization. Since low-volatility components such as unreacted remaining monomers and decomposition products of an initiator can be all distilled off upon elimination of the solvent, it is possible to obtain a homogeneous resin which contains very little impurities and is stable electrically. The resin is therefore considered to be optimal for use in the production of a toner. Production of a crosslinked polymer by solution polymerization is however accompanied by the problem that the production cannot be continued due to occurrence of Weissenberg effect, that is, winding of the resin around a stirring shaft. The present inventors hence developed a process for achieving polymerization to a degree as high as possible in bulk or the like (see U.S. Pat. No. 5,084,368). A limitation is however imposed on the molecular weight available by the polymerization process, so that the offset problem has not been overcome fully. Further, Japanese Patent Publication No. 38700/1985 discloses a toner binder produced by heating and mixing (A) a copolymer containing 3–40% of a glycidyl-containing monomer and (B) a crosslinkable compound. The toner however contains many remaining epoxy groups so that toner particles of opposite charge are formed in a long-term test. The toner therefore involves a problem in durability. No fully satisfactory toner has been developed yet accordingly.

SUMMARY OF THE INVENTION

An object of the present invention is to satisfy the requirements described above. It has been found that a toner capable of meeting requirements even for high-speed copying machines, while assuring well-balanced fixing property, offset resistance and blocking resistance and good grindability can be obtained by crosslinking a specific resin, which has been produced by solution polymerization, with a glycidyl-containing compound at a predetermined ratio, leading to the completion of the present invention.

In one aspect of this invention, there is thus provided an electrophotographic toner which comprises at least a colorant, a binder and a charge control agent, said binder being composed of (A) a COOH-containing vinyl resin which has a number-average molecular weight (Mn) of 1,000–20,000, a weight-average molecular weight (Mw) of 50,000–1,000,000, Mw/Mn being at least 3.5, an acid value of 1.0–10 and a glass transition temperature (Tg) of 40°–75° C.; and (B) a glycidyl compound in an amount sufficient to provide 0.05–1.0 equivalent of glycidyl groups per equivalent of COOH groups in the COOH-containing vinyl resin (A).

In another aspect of this invention, there is also provided a process for the production of an electrophotographic toner which comprises melting and kneading a composition formed of a colorant, a charge control agent and a binder, said binder being composed of (A) a COOH-containing vinyl resin which has a number-average molecular weight (Mn) of 1,000–20,000, a weight-average molecular weight (Mw) of 50,000–1,000,000, Mw/Mn being at least 3.5, an acid value of 1.0–10 and a glass transition temperature (Tg) of 40°–75° C. and (]3) a glycidyl compound in an amount sufficient to provide 0.05–1.0 equivalent of glycidyl groups per equivalent of COOH groups in the COOH-containing vinyl resin (A), and then finely pulverizing the resultant mass.

DETAILED DESCRIPTION OF THE INVENTION

For the preparation of the COOH-containing vinyl resin (A) which is one of the component of the binder in the present invention, it is preferred to copolymerize at least one carboxylic acid or a derivative thereof (hereinafter called COOH-containing vinyl monomer) with a further vinyl monomer copolymerizable with the COOH-containing vinyl monomer. Examples of the COOH-containing vinyl monomer include acrylic acid, methacrylic acid, maleic anhydride, maleic acid, fumaric acid, cinnamic acid, and monoesters of unsaturated dibasic acids such as methyl fumarate, ethyl fumarate, propyl fumarate, butyl fumarate, octyl fumarate, methyl maleate, ethyl maleate, propyl maleate, butyl maleate and octyl maleate.

Examples of the further vinyl monomer copolymerizable with the COOH-containing vinyl monomer include styrenes such as styrene, p-methylstyrene, α-methylstyrene and vinyl toluene; acrylic esters such as methyl acrylate, ethyl acrylate, propyl acrylate, butyl acrylate, octyl acrylate, cyclohexyl acrylate, stearyl acrylate, benzyl acrylate, furfuryl acrylate, hydroxyethyl acrylate, hydroxybutyl acrylate, dimethylaminomethyl acrylate and dimethylaminoethyl acrylate; methacrylic esters such as methyl methacrylate, ethyl methacrylate, propyl methacrylate, butyl methacrylate, octyl methacrylate, cyclohexyl methacrylate, stearyl methacrylate, benzyl methacrylate, furfuryl methacrylate, hydroxyethyl methacrylate, hydroxybutyl methacrylate, dimethylaminomethyl methacrylate and dimethylaminoethyl methacrylate; diesters of unsaturated dibasic acids such as dimethyl fumarate, dibutyl fumarate, dioctyl fumarate, dimethyl maleate, dibutyl maleate and dioctyl maleate; nitriles such as acrylonitrile and methacrylonitrile; amides such as acrylamide, methacrylamide, N-substituted acrylamide and N-substituted methacrylamide; and acrylamidopropanesulfonic acid. Among them, particularly preferred are styrenes, acrylic esters, methacrylic esters, dialkyl fumarates, acrylonitrile, acrylamide and methacrylamide.

The COOH-containing vinyl resin (A) is preferably a resin having a wide molecular-weight distribution, that is, having a number-average molecular weight of 1,000–20,000 and a weight-average molecular weight of 50,000–1,000,000, Mw/Mn being at least 3.5, and having a glass transition temperature (Tg) of 40°–75° C. Number-average molecular weights smaller than 1,000 results in glass transition temperatures lower than 40° C., thereby inducing blocking. Number-average molecular weights greater than 20,000, on the other hand, lead to reduced flowability and hence to deteriorated fixing property. A number-average molecular weight outside the above range is therefore not preferred. In addition, when the weight-average molecular weight is smaller than 50,000, substantial crosslinking is required for improved offset resistance. An increase in crosslinking, however, leads to a higher whole molecular weight and thus to deteriorated fixing property. Weight-average molecular weights larger than 1,000,000, on the other hand, cause gelation at a smaller crosslinking degree so that the fixing property is deteriorated. It is difficult to achieve a good balance between fixing property and offset resistance especially at an Mw/Mn ratio smaller than 3.5. An improvement in offset resistance inevitably leads to a deterioration in fixing property.

If the glass transition temperature exceeds 75° C., the softening point increases, thereby impairing the fixing property so that the target toner cannot be obtained. Furthermore, the COOH content of the COOH-containing vinyl resin (A) is preferably 1.0–10 KOH mg/g in terms of acid value. Acid values smaller than 1.0 KOH mg/g are too small to exhibit the advantages of the present invention. If the acid value is greater than 10 KOH mg/g, on the other hand, gelation takes place even at low crosslinking degree and the resulting gel separates and precipitates in the resin. The viscosity is therefore not increased, failing to improve the offset resistance.

Preferred as the glycidyl compound (B) in the present invention is a glycidyl-ester-containing vinyl resin which has a weight-average molecular weight of 3,000–10,000 and an epoxy value of 0.01–0.2 eq/100 g. The glycidyl-ester-containing vinyl resin is obtained by copolymerizing at least one glycidyl-containing vinyl monomer, such as glycidyl acrylate, β-methylglycidyl acrylate, glycidyl methacrylate or β-methylglycidyl methacrylate, with a further vinyl monomer. If the weight-average molecular weight of the resin is smaller than 3,000, the viscosity is hardly increased even when crosslinked, thereby failing to improve the offset resistance. If the weight-average molecular weight is greater than 10,000, on the other hand, the compatibility of the crosslinked substance is deteriorated during the crosslinking reaction and the crosslinked substance separates and precipitates in the resin. The viscosity is therefore not increased, failing to improve the offset resistance. In addition, the epoxy value is preferably in a range of 0.01–0.2 eq/100 g. If the epoxy value is smaller than 0.01 eq/100 g, no substantial viscosity increase occurs so that the offset resistance cannot be improved. An epoxy value greater than 0.2 eq/100g, on the other hand, leads to a crosslinked substance having deteriorated compatibility so that the crosslinked substance separates and precipitates in the resin. Despite the formation of gel, the viscosity is not increased so that the offset resistance is not improved.

Concerning the ratio of the glycidyl compound (B) to the COOH-containing vinyl resin (A) in the present invention, the glycidyl compound (B) is used in an amount sufficient to provide 0.05–1.0 equivalent of glycidyl groups per equivalent of COOH groups in the COOH-containing glycidyl resin (A). If the ratio is smaller than 0.05 equivalent, the advantages of the present invention cannot be exhibited. Ratios greater than 1.0, on the other hand, cause fluctuations in charge during a long-term durability test. Ratios outside the above range, therefore, are not preferred.

As a process for the production of the COOH-containing vinyl resin (A), solution polymerization is preferred. Furthermore, it is preferred to blend a low-molecular resin with a high-molecular resin for the production of a resin having such a wide molecular-weight distribution as described above. An illustrative production process will hereinafter be described. A homogeneous solution of the vinyl monomers and a polymerization initiator in at least one solvent selected from aromatic hydrocarbons—such as benzene, toluene, ethylbenzene, xylene and cumene—"Solvesso #100" and "Solvesso #150" (trade names; products of Esso Kagaku K.K.) is continuously charged into a pressure vessel, which has been filled up with the solvent in advance, while the temperature and internal pressure of the vessel are kept constant, whereby polymerization is conducted. After attainment of a steady state, the polymerization mixture is stored in a tank to provide a low-molecular polymer solution. In addition, a high-molecular polymer solution is obtained by bulk polymerization. The high-molecular solution and the low-molecular solution are thoroughly mixed together. The resultant mixture is subjected to solvent removal by flush distillation in a vacuum system of about 0–200 mmHg. The vinyl resin and the solvent are thus separated, whereby a COOH-containing vinyl resin (A) can be obtained in a solid form.

The two components of the binder which is a characteristic element in the present invention, namely, the COOH-containing vinyl resin (A) and the glycidyl compound (B) can be reacted in various ways as will be described below:

(1) After the COOH-containing vinyl resin (A) is mixed with the glycidyl compound (B) in a Henschel mixer, the resultant mixture is molten and kneaded at 160°–220° C. with a twin-screw kneader or the like to thoroughly conduct the reaction between COOH groups and glycidyl groups. To the resultant mass, toner additives such as a colorant and a charge control agent are added to provide a toner.

(2) The COOH-containing vinyl resin (A) and the glycidyl compound (B) are, in their unreacted forms, thoroughly mixed with toner additives such as a colorant and a charge control agent, and then the resultant mixture is molten and kneaded into a toner at 160°–220° C. with a twin-screw kneader. During this toner-forming step, the two components are reacted.

(3) The COOH-containing vinyl resin (A) and the glycidyl compound (B) are, in their unreacted forms, thoroughly mixed with toner additives such as a colorant and a charge control agent. The resultant mixture is molten and kneaded at 110°–140° C. with a twin-screw kneader without any substantial reaction between the two components. At the time of fixing of the resultant toner in a copying machine, the temperature of hot rolls is raised to 160°–220° C. to react the two components.

Although these processes can all be employed, it is most effective to react the two components at the time of melting and kneading.

In the present invention, a widely used, known dye or pigment can be employed as the colorant. Exemplary colorants include black pigments such as carbon black, acetylene black, lamp black and magnetite; chrome yellow, yellow iron oxide, hansa yellow G, quinoline yellow lake, permanent yellow NCG, molybdenum orange, vulcan orange, indanthrenes, brilliant orange GK, red iron oxide, brilliant carmine 6B, flizarin lake, methyl violet lake, fast violet B, cobalt blue, alkali blue lake, phthalocyanin blue, fast sky blue, pigment green B, malachite green lake, titanium oxide and zinc white; and magnetic powders such as magnetite and soft ferrite. They may each be used generally in an amount of 0.1–20 parts by weight per 100 parts by weight of the toner components as measured prior to mixing.

In the present invention, other resins such as polyester resins, polyamide resins, vinyl chloride resins, polyvinyl butyral resins, styrene-butadiene resins, cumarone-indene resins, melamine resins and polyolefin resins can each be mixed in part to an extent not impairing the objects of the present invention. In addition, a known charge control agent led by nigrosine, a quaternary ammonium salt or a metal-containing azo dye can be suitably selected and used. They may each be used in an amount of 0.1–10 parts by weight per 100 parts by weight of the toner components as measured prior to mixing.

In the present invention, any methods known per se in the art can be employed for the production of the toner. For example, the resins, a colorant, a charge control agent, wax and the like are premixed. The premix is heated, molten and kneaded with a twin-screw kneader. The resultant mass is then cooled, pulverized and classified, whereby fine particles of about 10 μm are obtained.

The number-average molecular weight and weight-average molecular weight as referred to in the present invention are those determined by GPC. They are molecular weights converted in accordance with a calibration curve which was drawn based on monodisperse standard polystyrene. Measurement conditions are as shown below:

GPC apparatus: "JASCO TWINCLE HPLC"
Detector: "SHODEX RI SE-31"
Column: "SHODEX GPCA-80M"×2+"SHODEX KF-802"
Solvent: Tetrahydrofuran
Flow rate: 1.2 ml/min

EXAMPLES

The present invention will hereinafter be described more specifically by the following examples, in which all designations of "part" or "parts" mean part or parts by weight unless otherwise specifically indicated.

[Synthesis Example of COOH-Containing Vinyl Resin (A)]

Synthesis Example 1

In a solution of 69.3 parts of styrene and 0.7 part of methacrylic acid in 30 parts of xylene, 0.5 part, per 100 parts of styrene, of di-t-butyl peroxide was uniformly dissolved. The resulting solution was continuously charged at 750 cc/hr into a 5E-reactor maintained at an internal temperature of 200° C. and an internal pressure of 6 kg/cm$^2$ to conduct polymerization, whereby a low-molecular polymer solution was obtained.

Into a nitrogen-purged flask, on the side, 66 parts of styrene, 33 parts of n-butyl methacrylate and 1 part of methacrylic acid were charged as vinyl monomers. The internal temperature of the flask was then raised to 120° C. While maintaining the flask at the same temperature, bulk polymerization was conducted for 10 hours. The polymerization rate at that time was 51%. Xylene (50 parts) was thereafter added to the flask and a solution, which had been obtained in advance by mixing and dissolving 0.1 part of dibutyl peroxide in 50 parts of xylene, was continuously added to the mixture over 8 hours while maintaining the temperature at 130° C. Polymerization was conducted for additional 2 hours to polymerize any remaining monomers so that polymerization was completed to obtain a high-molecular polymer solution. Next, 100 parts of the low-molecular polymer solution and 140 parts of the high-molecular polymer solution were combined together. The resultant mixture was subjected to solvent removal by flush distillation in a vessel of 160° C. and 10 mmHg. The resultant vinyl resin had a number-average molecular weight of 3800, a weight-average molecular weight of 210,000, a Tg of 63° C. and an acid value of 6.2.

Synthesis Examples 2 and 3

In a similar manner to Synthesis Example 1 except that, upon production of the low-molecular polymer solution, the polymerization temperature was changed from 200° C. to 180° C. and 220° C., respectively, vinyl resins were obtained. The physical property values of the vinyl resins so obtained are shown in Table 1.

Synthesis Example 4

In a similar manner to Synthesis Example 1 except that, upon production of the low-molecular polymer solution, the polymerization temperature was changed from 200° C. to 160° C., a vinyl resin was obtained. The physical property values of the vinyl resin so obtained are shown in Table 1.

Synthesis Examples 5, 6 and 12

In a similar manner to Synthesis Example 1 except that the low-molecular polymer solution/high-molecular polymer solution ratio was changed from 100/140 to 100/70, 100/14 and 100/420, respectively, vinyl resins were obtained. The physical property values of the vinyl resins so obtained are shown in Table 1.

Synthesis Example 7

In a similar manner to Synthesis Example 1 except that, upon production of the low-molecular polymer solution, 65.1 parts of styrene, 4.2 parts of n-butyl acrylate and 0.7 part of methacrylic acid were used as vinyl monomers instead of 69.3 parts of styrene and 0.7 part of methacrylic acid, a vinyl resin was obtained. The physical property values of the vinyl resin so obtained are shown in Table 1.

Synthesis Example 8

In a similar manner to Synthesis Example 1 except that, upon production of the high-molecular polymer solution, 79 parts of styrene, 20 parts of octyl fumarate and 1 part of methacrylic acid were used as the vinyl monomers instead of 66 parts of styrene, 33 parts of n-butyl methacrylate and 1 part of methacrylic acid, a vinyl resin was obtained. The physical property values of the vinyl resin so obtained are shown in Table 1.

Synthesis Example 9

In a similar manner to Synthesis Example 1 except that, upon production of the high-molecular polymer solution, 69 parts of styrene, 30 parts of n-butyl methacrylate and 1 part of monobutyl maleate were used as the vinyl monomers instead of 66 parts of styrene, 33 parts of n-butyl methacrylate and 1 part of methacrylic acid, a vinyl resin was obtained. The physical property values of the vinyl resin so obtained are shown in Table 1.

Synthesis Example 10

In a similar manner to Synthesis Example 1 except that, upon production of the low-molecular polymer solution, 60.9 parts of styrene, 6.3 parts of n-butyl acrylate and 2.8 parts of methacrylic acid were used as the vinyl monomers instead of 69.3 parts of styrene and 0.7 part of methacrylic acid, a vinyl resin was obtained. The physical property values of the vinyl resin so obtained are shown in Table 1.

Synthesis Example 11

In a similar manner to Synthesis Example 1 except that, upon production of the low-molecular polymer solution, styrene was replaced by methacrylic acid, a vinyl resin was obtained. The physical property values of the vinyl resin so obtained are shown in Table 1.

Example 1

In a Henschel mixer, 86 parts of the vinyl resin obtained in Synthesis Example 1 and 2.5 parts of a glycidyl-containing styrene-acryl resin ("PD6300", trade name; product of Mitsui Toatsu Chemicals, Inc., epoxy value: 0.19 eq/100 g, weight-average molecular weight: 8,000, Tg: 52° C.) were mixed. The mixture was kneaded and reacted at 200° C. with a twin-screw kneader ("PCM-30", trade name; manufactured by Ikegai Tekko Co., Ltd.). The mass so formed was cooled and pulverized, followed by the addition of 8 parts of carbon black ("MA100", trade name; product of Mitsubishi Kasei Corporation), 5 parts of polypropylene wax ("Biscol 550P", trade name; product of Sanyo Kasei K.K.) and, as a charge control agent, 1 part of "Eisen Spiron Black TRH" (trade name; product of Hodogaya Kagaku K.K.). They were mixed in a Henschel mixer. The resultant mixture was thereafter kneaded at 150° C. with the twin-screw kneader ("PCM-30", trade name; manufactured by Ikegai Tekko Co., Ltd.). The mass so formed was cooled, pulverized and classified, whereby a toner having a particle size of about 10 μm was obtained. Using a mixture consisting of 3 parts of the toner so obtained and 97 parts of a carrier as a developing agent and a modified commercial copying machine, pictures were obtained. Evaluation results of the pictures are presented in Table 1.

Example 2

A toner was obtained as in Example 1 except that the vinyl resin obtained in Synthesis Example 2 was used instead of the vinyl resin obtained in Synthesis Example 1. In exactly the same manner as in Example 1, pictures were evaluated. The evaluation results are presented in Table 1.

Example 3

A toner was obtained as in Example 1 except that the vinyl resin obtained in Synthesis Example 3 was used instead of the vinyl resin obtained in Synthesis Example 1. In exactly the same manner as in Example 1, pictures were evaluated. The evaluation results are presented in Table 1.

Example 4

A toner was obtained as in Example 1 except that the vinyl resin obtained in Synthesis Example 5 was used instead of the vinyl resin obtained in Synthesis Example 1. In exactly the same manner as in Example 1, pictures were evaluated. The evaluation results are presented in Table 1.

Example 5

A toner was obtained as in Example 1 except that the amount of PD6300 was decreased from 2.5 parts to 1.25 parts. In exactly the same manner as in Example 1, pictures were evaluated. The evaluation results are presented in Table 1.

Example 6

A toner was obtained as in Example 1 except that PD6300 was replaced by PD6100 (trade name of a glycidyl-containing styrene-acryl resin produced by Mitsui Toatsu Chemicals, Inc., epoxy value: 0.10 eq/100 g, weight-average molecular weight: 8,000, Tg: 56° C.). In exactly the same manner as in Example 1, pictures were evaluated. The evaluation results are presented in Table 1.

Example 7

A toner was obtained as in Example 1 except that the vinyl resin obtained in Synthesis Example 7 was used instead of the vinyl resin obtained in Synthesis Example 1. In exactly the same manner as in Example 1, pictures were evaluated. The evaluation results are presented in Table 1.

Example 8

A toner was obtained as in Example 1 except that the vinyl resin obtained in Synthesis Example 8 was used instead of the vinyl resin obtained in Synthesis Example 1. In exactly the same manner as in Example 1, pictures were evaluated. The evaluation results are presented in Table 1.

Example 9

A toner was obtained as in Example 1 except that the vinyl resin obtained in Synthesis Example 9 was used instead of the vinyl resin obtained in Synthesis Example 1. In exactly the same manner as in Example 1, pictures were evaluated. The evaluation results are presented in Table 1.

Examples 10 and 11

Mixed in a Henschel mixer were 86 parts of the vinyl resin obtained Synthesis Example 1, 2.5 parts of a glycidyl-containing styrene-acryl resin ("PD6300", trade name; product of Mitsui Toatsu Chemicals, Inc.), 8 parts of carbon black ("MA100", trade name; product of Mitsubishi Kasei Corporation), 5 parts of polypropylene wax ("Biscol 550P", trade name; product of Sanyo Kasei K.K.) and, as a charge control agent, 1 part of "Eisen Spiron Black TRH" (trade name; Hodogaya Kagaku K.K.). The resultant mixture was thereafter kneaded at 130° C. and 170° C. with a twin-screw kneader ("PCM-30", trade name; manufactured by Ikegai Tekko Co., Ltd.). In exactly the same manner as in Example 1, a toner was obtained and pictures were evaluated. The evaluation results are presented in Table 1.

Examples 12

Mixed in a Henschel mixer were 86 parts of the vinyl resin obtained in Synthesis Example 1, 2.5 parts of "PD6300", 8 parts of carbon black ("MA100", trade name; product of Mitsubishi Kasei Corporation), 5 parts of polypropylene wax ("Biscol 550P", trade name; product of Sanyo Kasei K.K.) and, as a charge control agent, 2 parts of cetyltrimethylammonium bromide. The resultant mixture was thereafter kneaded at 150° C. with a twin-screw kneader ("PCM-30", trade name; manufactured by Ikegai Tekko Co., Ltd.). The mass so obtained was then cooled, pulverized and classified, whereby a toner having a particle size of about 10 μm was obtained. Using a mixture consisting of 3 parts of the toner so obtained and 97 parts of a carrier, as a developing agent, and a modified, commercial, high-speed copying machine which employs positive charge toner, pictures were obtained. The pictures were evaluated in the same manner as in Example 1. The evaluation results are presented in Table 1.

TABLE 1 (1)

| Example No. | | | 1 | 2 | 3 | 4 |
|---|---|---|---|---|---|---|
| Synthesis Example No. | | | 1 | 2 | 3 | 5 |
| Low-molecular polymer solution | Composition | Styrene | 99 | 99 | 99 | 99 |
| | | N-butyl acrylate | — | — | — | — |
| | | Methacrylic acid | 1 | 1 | 1 | 1 |
| | Polymerization Temperature (°C.) | | 200 | 180 | 220 | 200 |
| High-molecular polymer solution | Composition | Styrene | 66 | 66 | 66 | 66 |
| | | N-butyl methacrylate | 33 | 33 | 33 | 33 |
| | | Methacrylic acid | 1 | 1 | 1 | 1 |
| | | Dioctyl fumarate | — | — | — | — |
| | | Monobutyl maleate | — | — | — | — |

TABLE 1 (1)-continued

| | | | | | | |
|---|---|---|---|---|---|---|
| Low-molecular resin/high-molecular resin ratio | | | 70/70 | 70/70 | 70/70 | 70/35 |
| COOH-containing vinyl resin | Tg (°C.) | | 63 | 67 | 56 | 64 |
| | Acid value (KOH mg/g) | | 6.2 | 6.2 | 6.1 | 6.2 |
| | Molecular weight | Mn | 3,800 | 8,800 | 2,800 | 3,300 |
| | | Mw | 210,000 | 230,000 | 200,000 | 120,000 |
| | | Mw/Mn | 55.3 | 26.1 | 71.4 | 36.4 |
| Glycidyl compound | Trade name | | PD6300 | PD6300 | PD6300 | PD6300 |
| | Epoxy value (Eq/100 g) | | 0.19 | 0.19 | 0.19 | 0.19 |
| | Mw | | 8,000 | 8,000 | 8,000 | 8,000 |
| | Tg (°C.) | | 52 | 52 | 52 | 52 |
| Vinyl resin/glycidyl compound (weight ratio) | | | 86/2.5 | 86/2.5 | 86/2.5 | 86/2.5 |
| COOH/glycidyl molar ratio in vinyl resin and glycidyl compound | | | 2/1 | 2/1 | 2/1 | 2/1 |
| Toner property | Grindability | | A | B | A | A |
| | Fixing property (°C.) | | 150 | 160 | 140 | 150 |
| | Offset resistance (°C.) | | 230< | 230< | 230< | 220 |
| | Blocking resistance | | A | A | B | A |
| | High-speed durability | | A | A | A | A |
| Example No. | | | 5 | 6 | 7 | 8 |
| Synthesis Example No. | | | 1 | 1 | 7 | 8 |
| Low-molecular polymer solution | Composition | Styrene | 99 | 99 | 93 | 99 |
| | | N-butyl acrylate | — | — | 6 | — |
| | | Methacrylic acid | 1 | 1 | 1 | 1 |
| | Polymerization Temperature (°C.) | | 200 | 200 | 200 | 200 |
| High-molecular polymer solution | Composition | Styrene | 66 | 66 | 66 | 79 |
| | | N-butyl methacrylate | 33 | 33 | 33 | — |
| | | Methacrylic acid | 1 | 1 | 1 | 1 |
| | | Dioctyl fumarate | — | — | — | 20 |
| | | Monobutyl maleate | — | — | — | — |
| Low-molecular resin/high-molecular resin ratio | | | 70/70 | 70/70 | 70/70 | 70/70 |
| COOH-containing vinyl resin | Tg (°C.) | | 63 | 63 | 61 | 62 |
| | Acid value (KOH mg/g) | | 6.2 | 6.2 | 6.3 | 6.2 |
| | Molecular weight | Mn | 3,800 | 3,800 | 3,900 | 3,500 |
| | | Mw | 210,000 | 210,000 | 230,000 | 194,000 |
| | | Mw/Mn | 55.3 | 55.3 | 59.0 | 55.4 |
| Glycidyl compound | Trade name | | PD6300 | PD6100 | PD6300 | PD6300 |
| | Epoxy value (Eq/100 g) | | 0.19 | 0.09 | 0.19 | 0.19 |
| | Mw | | 8,000 | 8,000 | 8,000 | 8,000 |
| | Tg (°C.) | | 52 | 56 | 52 | 52 |
| Vinyl resin/glycidyl compound (weight ratio) | | | 86/1.25 | 86/2.5 | 86/2.5 | 86/2.5 |
| COOH/glycidyl molar ratio in vinyl resin and glycidyl compound | | | 4/1 | 4/1 | 2/1 | 2/1 |
| Toner property | Grindability | | A | A | A | A |
| | Fixing property (°C.) | | 150 | 150 | 150 | 150 |
| | Offset resistance (°C.) | | 230< | 230< | 230< | 230< |
| | Blocking resistance | | A | A | A | A |
| | High-speed durability | | A | A | A | A |
| Example No. | | | 9 | 10 | 11 | 12 |
| Synthesis Example No. | | | 9 | 1 | 1 | 1 |
| Low-molecular polymer solution | Composition | Styrene | 99 | 99 | 99 | 99 |
| | | N-butyl acrylate | — | — | — | — |
| | | Methacrylic acid | 1 | 1 | 1 | 1 |
| | Polymerization Temperature (°C.) | | 200 | 200 | 200 | 200 |
| High-molecular polymer solution | Composition | Styrene | 69 | 66 | 66 | 66 |
| | | N-butyl methacrylate | 30 | 33 | 33 | 33 |
| | | Methacrylic acid | — | 1 | 1 | 1 |
| | | Dioctyl fumarate | — | — | — | — |
| | | Monobutyl maleate | 1 | — | — | — |
| Low-molecular resin/high-molecular resin ratio | | | 70/70 | 70/70 | 70/70 | 70/70 |
| COOH-containing vinyl resin | Tg (°C.) | | 56 | 63 | 63 | 63 |
| | Acid value (KOH mg/g) | | 6 | 6.2 | 6.2 | 6.2 |
| | Molecular weight | Mn | 3,300 | 3,800 | 3,800 | 3,800 |
| | | Mw | 188,000 | 210,000 | 210,000 | 210,000 |
| | | Mw/Mn | 57.0 | 55.3 | 55.3 | 55.3 |
| Glycidyl compound | Trade name | | PD6300 | PD6300 | PD6300 | PD6300 |
| | Epoxy value (Eq/100 g) | | 0.19 | 0.19 | 0.19 | 0.19 |
| | Mw | | 8.000 | 8.000 | 8,000 | 8.000 |
| | Tg (°C.) | | 52 | 52 | 52 | 52 |
| Vinyl resin/glycidyl compound (weight ratio) | | | 86/2.5 | 8612.5 | 86/2.5 | 86/2.5 |
| COOH/glycidyl molar | | | 2/1 | 2/1 | 2/1 | 2/1 |

TABLE 1 (1)-continued

| | | | | | |
|---|---|---|---|---|---|
| ratio in vinyl resin and glycidyl compound | | | | | |
| Toner property | Grindability | A | A | A | A |
| | Fixing property (°C.) | 140 | 150 | 140 | 140 |
| | Offset resistance (°C.) | 230< | 230< | 220 | 230< |
| | Blocking resistance | B | A | 8 | A |
| | High-speed durability | A | A | A | A |

Comparative Example 1

A toner was obtained as in Example 1 except that the glycidyl compound was not used. In exactly the same manner as in Example 1, pictures were evaluated. The evaluation results are presented in Table 2.

Comparative Example 2

A toner was obtained as in Example 1 except that the vinyl resin obtained in Synthesis Example 4 was used instead of the vinyl resin obtained in Synthesis Example 1. In exactly the same manner as in Example 1, pictures were evaluated. The evaluation results are presented in Table 2.

Comparative Example 3

A toner was obtained as in Example 1 except that the vinyl resin obtained in Synthesis Example 6 was used instead of the vinyl resin obtained in Synthesis Example 1. In exactly the same manner as in Example 1, pictures were evaluated. The evaluation results are presented in Table 2.

Comparative Example 4

A toner was obtained as in Example 1 except that the vinyl resin obtained in Synthesis Example 10 was used instead of the vinyl resin obtained in Synthesis Example 1. In exactly the same manner as in Example 1, pictures were evaluated. The evaluation results are presented in Table 2.

Comparative Example 5

A toner was obtained as in Example 1 except that the vinyl resin obtained in Synthesis Example 11 was used instead of the vinyl resin obtained in Synthesis Example 1. In exactly the same manner as in Example 1, pictures were evaluated. The evaluation results are presented in Table 2.

Comparative Example 6

A toner was obtained as in Example 1 except that the vinyl resin obtained in Synthesis Example 12 was used instead of the vinyl resin obtained in Synthesis Example 1 and the glycidyl compound was not used. In exactly the same manner as in Example 1, pictures were evaluated. The evaluation results are presented in Table 2.

TABLE 2(1)

| | | | | | |
|---|---|---|---|---|---|
| Comparative Example No. | | | 1 | 2 | 3 |
| Synthesis Example No. | | | 1 | 4 | 6 |
| Low-molecular polymer solution | Composition | Styrene | 99 | 99 | 99 |
| | | N-butyl acrylate | — | — | — |
| | | Methacrylic acid | 1 | 1 | 1 |
| | Polymerization Temperature (°C.) | | 200 | 160 | 200 |
| High-molecular polymer solution | Composition | Styrene | 66 | 66 | 66 |
| | | N-butyl methacrylate | 33 | 33 | 33 |
| | | Methacrylic acid | 1 | 1 | 1 |
| | | Dioctyl fumarate | — | — | — |
| | | Monobutyl maleate | — | — | — |
| Low-molecular resin/high-molecular resin ratio | | | 70/70 | 70/70 | 70/7 |
| COOH-containing vinyl resin | Tg (°C.) | | 63 | 74 | 65 |
| | Acid value (KOH mg/g) | | 6.2 | 6.2 | 6 |
| | Molecular weight | Mn | 3,800 | 21,000 | 3,300 |
| | | Mw | 210,000 | 340,000 | 47,000 |
| | | Mw/Mn | 55.3 | 16.2 | 14.2 |
| Glycidyl compound | Trade name | | — | PD6300 | PD6300 |
| | Epoxy value (Eq/100 g) | | — | 0.19 | 0.19 |
| | Mw | | — | 8,000 | 8,000 |
| | Tg (°C.) | | — | 52 | 52 |
| Vinyl resin/glycidyl compound (weight ratio) | | | 86/0 | 86/2.5 | 86/2.5 |
| COOH/glycidyl molar ratio in vinyl resin and glycidyl compound | | | 1/0 | 2/1 | 2/1 |
| Toner property | Grindability | | A | D | A |
| | Fixing property (°C.) | | 150 | 190 | 140 |
| | Offset resistance (°C.) | | 190 | 230< | 150 |
| | Blocking resistance | | A | A | A |
| | High-speed durability | | B | C | C |
| Comparative Example No. | | | 4 | 5 | 6 |
| Synthesis Example No. | | | 10 | 11 | 12 |
| Low-molecular polymer solution | Composition | Styrene | 87 | 100 | 99 |
| | | N-butyl acrylate | 9 | — | — |
| | | Methacrylic acid | 4 | — | 1 |
| | Polymerization Temperature (°C.) | | 200 | 200 | 200 |

TABLE 2(1)-continued

| | | | | | |
|---|---|---|---|---|---|
| High-molecular polymer solution | Composition | Styrene | 66 | 67 | 66 |
| | | N-butyl methacrylate | 33 | 33 | 33 |
| | | Methacrylic acid | 1 | — | 1 |
| | | Dioctyl fumarate | — | — | — |
| | | Monobutyl maleate | — | — | — |
| Low-molecular resin/high-molecular resin ratio | | | 70/70 | 70/70 | 25/75 |
| COOH-containing vinyl resin | Tg (°C.) | | 59 | 62 | 61 |
| | Acid value (KOH mg/g) | | 15 | 0.2 | 6.2 |
| | Molecular weight | Mn | 3,600 | 3,700 | 10,200 |
| | | Mw | 210,000 | 230,000 | 310,000 |
| | | Mw/Mn | 58.3 | 62.2 | 30.4 |
| Glycidyl compound | Trade name | | PD6300 | PD6300 | — |
| | Epoxy value (Eq/100 g) | | 0.19 | 0.19 | — |
| | Mw | | 8,000 | 8,000 | — |
| | Tg (°C.) | | 52 | 52 | — |
| Vinyl resin/glycidyl compound (weight ratio) | | | 86/6.25 | 86/0.1 | 86/0 |
| COOH/glycidyl molar ratio in vinyl resin and glycidyl compound | | | 2/1 | 2/1 | 1/0 |
| Toner property | Grindability | | A | A | D |
| | Fixing property (°C.) | | 200 | 150 | 180 |
| | Offset resistance (°C.) | | 230< | 190 | 230< |
| | Blocking resistance | | B | A | A |
| | High-speed durability | | C | B | C |

[Evaluation methods of toners]

1) Fixing property

Copying was conducted while changing the temperature of fixing rolls 10° C. by 10° C. A rubber eraser ("MONO", trade mark; plastic eraser produced by Tombow Pencil Co., Ltd.) was reciprocated 100 times under predetermined constant pressure across a solid black area and the white background on each copy. The blackness of the solid black area was then measured by an ink densitometer, and the extent of dropping of the toner was indicated by a density ratio. The fixing property was expressed in terms of the lowest temperature at which at least 80% of the density was left.

2) Offset resistance

The temperature at which offsetting occurred upon copying was recorded as it was.

3) Blocking resistance

After each polymerized toner powder was left over for 1 week in an environment whose temperature and relative humidity were 50° C. and 50%, respectively, the extent of caking of the powder was visually ranked according to the following standard:

A: Absolutely no caking.

B: Caked a little, but loosened into powder when a container was shaken gently.

C: Some aggregates remained even after a container was shaken thoroughly.

D: Fully caked.

4) High-speed durability

A continuous test was conducted using a commercial high-speed copying machine (copying speed: 72 copies per-minute) until 10,000 copies of a pattern were made, whereby the reproducibility of the pattern was checked. A difference in image quality between copies made before and after the continuous test was determined.

A: Substantially no difference between copies made before and after the continuous test.

B: Significant reduction in ID (image density) after the continuous test.

C: Fogging occurred, resulting in a marked reduction in image quality.

5) Grindability

Upon production of each toner, a portion of the mass kneaded in the twin-screw kneader was collected subsequent to the cooling. The mass was pulverized into a particle size range of from under 10-mesh to on 16-mesh by a jet mill. The particle size distribution was measured by a Coulter counter to determine the percentage of 5–20 μm particles.

A: 85% and up.

B: 70% (inclusive) to 85%.

C: 50% (inclusive) to 70%.

D: less than 50%.

[Consideration based on the results]

As is presented in Table 1, it has been found that the offset resistance can be readily strengthened by the present invention. Further, each toner according to the present invention has well-balanced fixing property and blocking resistance and good grindability and high-speed durability so that it can show excellent performance in actual use.

We claim:

1. In an electrophotographic toner, comprising at least a colorant, a binder and a charge control agent, the improvement wherein the binder comprises a polymer obtained by reacting (A) and (B), wherein (A) is a COOH—containing vinyl resin having a number-average molecular weight (Mn) of 1,000–20,000, a weight-average molecular weight (Mw) of 50,000–1,000,000, Mw/Mn being at least 3.5, an acid value of 1.0–10 and a glass transition temperature (Tg) of 40°–75° C.; and (B) is a glycidyl-ester containing resin having an epoxy value of of 0.01–0.3 eq./100 g in an amount sufficient to provide 0.05–10 equivalent of glycidyl groups per equivalent of COOH groups in the COOH-containing vinyl resin (A); and obtained by reacting the COOH-containing vinyl resin (A) and the glycidyl-ester-containing resin (B).

2. The toner of claim 1, wherein the glycidyl-ester-containing resin (B) has a weight-average molecular weight of 3,000–10,000.

3. The toner of claim 1, wherein the COOH-containing vinyl resin (A) has been obtained by copolymerizing a monomer, which comprises at least one carboxylic acid or a carboxylic acid derivative selected from the group consisting of acrylic acid, methacrylic acid, maleic anhydride, maleic acid, fumaric acid, cinnamic acid and monoesters of unsaturated dibasic acids, with a further vinyl monomer copolymerizable therewith.

4. The toner of claim 3, wherein the further vinyl monomer is selected from styrenes, acrylate esters, methacrylate esters, dialkyl fumarates, acrylonitrile, acrylamide and methacrylamide.

5. A process for producing an electrophotographic toner, which comprises:

melting and kneading a composition composed of a colorant, a charge control agent and a binder, said binder being composed of a polymer obtained by reacting (A) and (B), wherein (A) is a COOH-containing vinyl resin having a number-average molecular weight (Mn) of 1,000–20,000, a weight-average molecular weight (Mw) of 50,000–1,000,000, Mw/Mn being at least 3.5, an acid value of 1.0–10 and a glass transition temperature (Tg) of 40°–75° C. and (B) is a glycidyl-ester-containing resin having an epoxy value of 0.01–0.3 eq./100 g in an amount sufficient to provide 0.05–1.0 equivalent of glycidyl groups per equivalent of COOH groups in the COOH-containing vinyl resin (A), reacting the COOH-containing vinyl resin (A) and the glycidyl-ester-containing resin (B), and finally pulverizing the resultant mass.

6. The process of claim 5, wherein at least a part of the COOH-containing vinyl resin (A) has been produced by solution polymerization.

7. The process of claim 6, wherein the COOH-containing vinyl resin (A) is a low-molecular polymer.

8. The process of claim 5, wherein at least a part of the COOH-containing vinyl resin (A) is a high-molecular polymer produced by bulk polymerization.

9. The process of claim 5, wherein the binder has been obtained by heating, melting, and kneading and reacting the COOH-containing vinyl resin (A) and the glycidyl compound (B) at 160°–220° C.

* * * * *